US007898189B2

(12) United States Patent
Yu

(10) Patent No.: US 7,898,189 B2
(45) Date of Patent: Mar. 1, 2011

(54) LIGHTING APPARATUS CAPABLE OF PROTECTING EYESIGHT

(76) Inventor: Hang Jae Yu, Sungnam-si (KR)

( * ) Notice: Subject to any disclaimer, the term of this patent is extended or adjusted under 35 U.S.C. 154(b) by 274 days.

(21) Appl. No.: 12/041,481

(22) Filed: Mar. 3, 2008

(65) Prior Publication Data

US 2008/0284353 A1 Nov. 20, 2008

(30) Foreign Application Priority Data

May 18, 2007 (KR) ..... 10-2007-48570

(51) Int. Cl.
*H05B 37/00* (2006.01)

(52) U.S. Cl. ..... 315/291; 315/224; 362/231; 362/253

(58) Field of Classification Search ..... 362/253, 362/262, 800, 228, 229, 230, 231; 315/291, 315/224, 307
See application file for complete search history.

(56) References Cited

U.S. PATENT DOCUMENTS 5,599,090 A 2/1997 Waldmann
2006/0007682 A1* 1/2006 Reiff et al. ..... 362/253

FOREIGN PATENT DOCUMENTS

| | | |
|---|---|---|
| DE | 10-2006-041-533 A1 | 3/2008 |
| KR | 20-0426127 | 9/2006 |
| KR | 10-2008-0009336 | 1/2008 |
| WO | WO-2005/012785 A1 | 2/2005 |
| WO | WO-2008/028857 A1 | 3/2008 |

* cited by examiner

*Primary Examiner*—David Hung Vu
(74) *Attorney, Agent, or Firm*—Birch, Stewart, Kolasch & Birch, LLP

(57) ABSTRACT

Disclosed herein is a lighting apparatus using one or more fluorescent lamps. The lighting apparatus according to the present invention includes one or more sockets, a board, a ballast, and a Direct Current (DC) power supply. The sockets accommodate the fluorescent lamps. The board supports Light Emitting Diodes (LEDs) for emitting green light in a wavelength range of 498 to 530 nm, LEDs for emitting red light in a wavelength range of 620 to 700 nm, and LEDs for emitting bluish green at 495 nm. The ballast provides a ballast function to the fluorescent lamps. The DC power supply supplies DC power to the LEDs.

8 Claims, 6 Drawing Sheets
(1 of 6 Drawing Sheet(s) Filed in Color)

LIGHTING APPARATUS CAPABLE OF PROTECTING EYESIGHT

BACKGROUND OF THE INVENTION

1. Field of the Invention

The present invention relates generally to a lighting apparatus capable of protecting eyesight and, more particularly, to a lighting apparatus capable of protecting eyesight that additionally emits light having wavelengths that are not emitted by existing fluorescent lighting apparatuses, but are essential to the action of eyesight.

2. Description of the Related Art

Various types of lighting apparatuses using fluorescent lamps are used as main lighting apparatuses in public facilities and homes. Meanwhile, fluorescent desk lamps, such as that shown in FIG. 1, are widely used as auxiliary desk lighting apparatuses in study rooms and laboratories.

In the meantime, when 60 Hz home Alternating Current (AC) power is used for fluorescent desk lamps without conversion, the fluorescent lamps flicker 120 times per second, which fatigues the eyes. Accordingly, fluorescent inverter desk lamps, which convert existing 60 Hz AC power into 44 KHz high-frequency power using electronic ballasts equipped with inverter circuits and apply the 44 KHz high-frequency power to lamps, so that the fluorescent lamps flicker 80,000 to 90,000 times per second, thereby preventing the eyes from detecting such flickering, are mainly used at present.

Furthermore, although lighting apparatuses using fluorescent lamps as main lighting lamps sometimes use electronic ballasts which are not equipped with inverter circuits, electronic ballasts equipped with inverter circuits have been used recently.

Meanwhile, since natural light (solar light) has a wide wavelength range of 380 to 780 nm and humans' eyesight is adapted to natural light, humans feel comfortable and, simultaneously, humans' eyesight can be protected when humans view objects that are illuminated with natural light.

Conventional fluorescent lamps are inexpensive (one to three dollar). However, since the fluorescent material applied to the inner glass of the fluorescent lamps is mainly a phosphate, silicate or tungstate compound, large amounts of blue light in a wavelength range of 430 to 450 nm, red-orange light in a wavelength range of 600 to 620 nm and yellow-green light in a range of 530 to 560 nm are emitted, and small amounts of pure red light in a wavelength range of 620 to 700 nm and pure green light in a wavelength range of 498 to 530 nm are emitted, as shown in the upper graph of FIG. 2, and thus the light emitted from the fluorescent lamps is different from natural light, which is composed of red, green and blue colors. Therefore, the conventional fluorescent lamps have problems related to color rendering, and thus they fatigue the eyes when humans' photoreceptor cells are used for a long time.

Meanwhile, humans' photoreceptor cells consist of cone cells and rod cells. The three types of cone cells, which detect color, are relatively sensitive to light at 420 nm, light at 530 nm, and light at 560 nm, respectively, and rod cells are relatively sensitive to light at about 495 nm.

In particular, recent research has proven that cone cells and rod cells participate in vision through interaction therebetween. This means that bluish green light at about 495 nm, to which rod cells, which have not been considered to be important in discerning red, green and blue light based on the conventional theory, in which only cone cells participate in the detection of color, are sensitive and improve sharpness, and thus they play an important role in vision.

However, existing fluorescent lamps emit slight amounts of bluish green light at about 495 nm, and thus they do not provide optimal conditions for the activity of photoreceptor cells.

In brief, the existing fluorescent lamps have problems rendering colors because they emit small amounts of pure red light in the wavelength range of 620 to 700 nm and pure green light in the wavelength range of 498 to 530 nm, and do not improve sharpness because they emit small amounts of bluish green light at about 495 nm.

In order to mitigate the shortcomings of the existing fluorescent lamps, full-spectrum fluorescent lamps, which are constructed by adding a phosphorus compound to fluorescent material for the existing fluorescent lamps and can emit light at red wavelengths, have been invented. However, it is impossible to manufacture them at low cost because the phosphorus compound is a rare material, and thus the material cost is increased, and because the yield thereof is low.

SUMMARY OF THE INVENTION

Accordingly, the present invention has been made keeping in mind the above problems occurring in the prior art, and an object of the present invention is to provide a lighting apparatus that emits light that is visually similar to natural light and can be manufactured at low cost.

In order to accomplish the above object, the present invention provides a lighting apparatus using one or more fluorescent lamps, including one or more sockets for accommodating the fluorescent lamps; a board for supporting Light Emitting Diodes (LEDs) for emitting green light in a wavelength range of 498 to 530 nm, LEDs for emitting red light in a wavelength range of 620 to 700 nm, and LEDs for emitting bluish green at about 495 nm; a ballast for providing a ballast function to the fluorescent lamps; and a Direct Current (DC) power supply for supplying DC power to the LEDs.

BRIEF DESCRIPTION OF THE DRAWINGS

The patent or application file contains at least one drawing executed in color. Copies of this patent or patent application publication with color drawing(s) will be provided by the office upon request and payment of the necessary fee.

The above and other objects, features and advantages of the present invention will be more clearly understood from the following detailed description, taken in conjunction with the accompanying drawings, in which.

DESCRIPTION OF THE PREFERRED EMBODIMENTS

Figure 1:
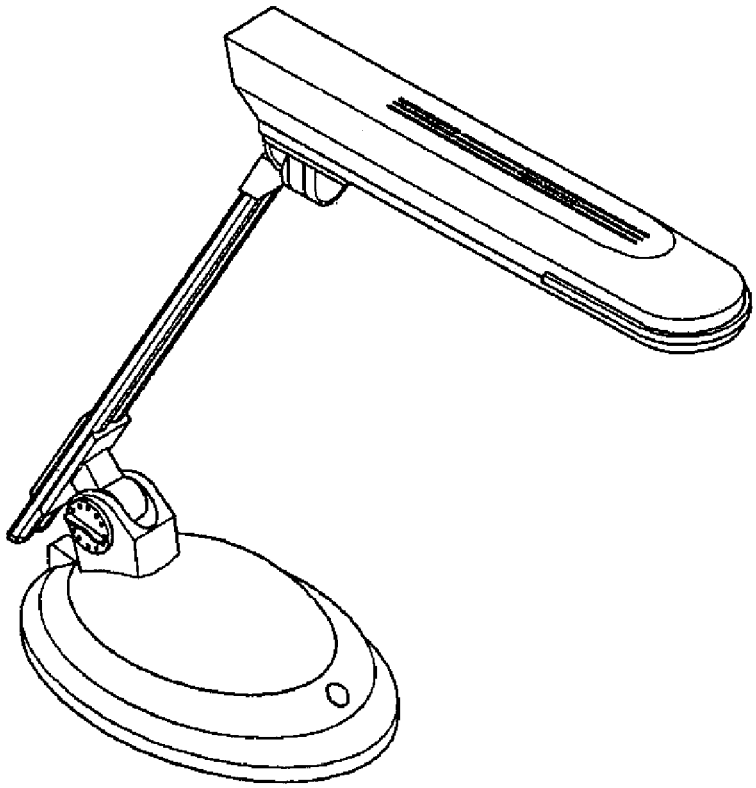
FIG. 1 is a perspective view showing a desk lamp using a conventional fluorescent lamp.

Reference now should be made to the drawings, in which the same reference numerals are used throughout the different drawings to designate the same or similar components.

Currently, commercial Light Emitting Diodes (LEDs), which emit light having various colors, are being marketed. However, since manufacturing a lighting apparatus by combining LEDs for various colors so as to emit light similar to natural light requires hundreds of LEDs to emit sufficient amount of light for such a lighting apparatus, a manufacturing cost higher than that for a fluorescent lamp is incurred, and it is difficult to control the considerable amount of heat emitted from the hundreds of LEDs, it is not desirable to manufacture a lighting apparatus for emitting light similar to natural light using only LEDs from the aspects of the manufacturing cost and the emission of heat.

Accordingly, in the present invention, a lighting apparatus is constructed using an inexpensive fluorescent lamp, which is currently the most efficient light source, as an inexpensive basic light source, and using LEDS, which are capable of forming light having wavelengths that are not emitted from such a fluorescent lamp but are essential to the formation of light similar to natural light, as will be described below, along with the fluorescent lamp, so that improved color rendering and sharpness can be realized, thereby being able to provide an inexpensive lighting apparatus capable of emitting light similar to natural light.

Figure 2:
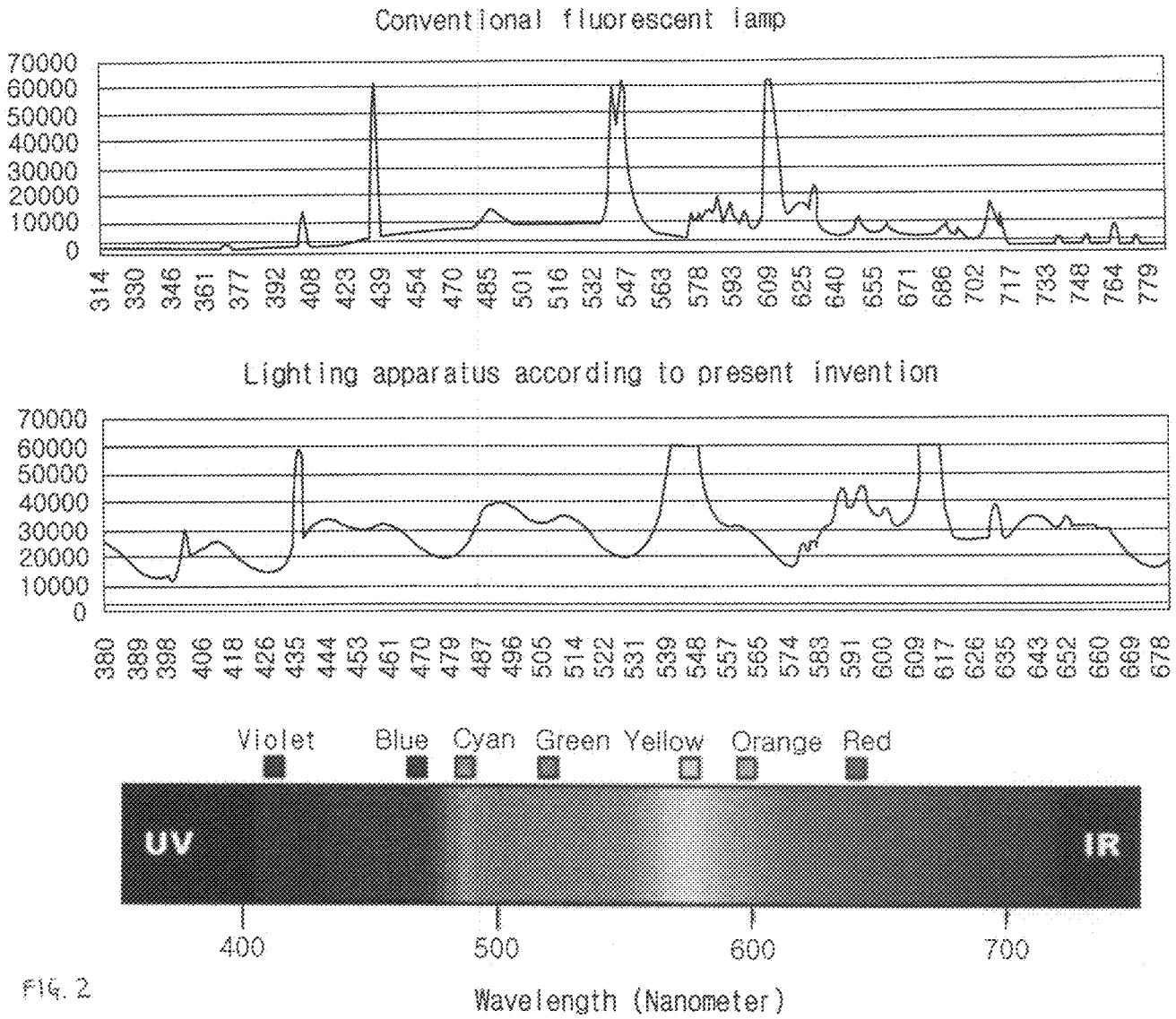
FIG. 2 is a diagram showing the distribution of wavelengths in the conventional fluorescent lamp and the distribution of wavelengths in a lighting apparatus according to the present invention.

According to the research of the inventor of the present invention, it is concluded that, when sufficient green light in a wavelength range of 498 to 530 nm and sufficient red light in a wavelength range of 620 to c495 nm, which are emitted in small amounts from a fluorescent lamp, are added to the light emitted from the fluorescent lamp, as shown in the lower graph of FIG. 2, color rendering is significantly improved, with the result that a human feels natural when he or she views objects, and thus his or her eyesight can be protected. Here, the wavelength c495 nm is obtained by combining a red wavelength with a violet wavelength. In practical implementation, it can be created by combining red wavelengths in a range of 620 to 700 nm and violet wavelengths in a range of 380 to 400 nm.

As a result, when green light in a wavelength range of 498 to 530 nm, red light in a wavelength range of 620 to 700 nm and violet light in a wavelength range of 380 to 400 nm are added to light emitted from an existing fluorescent lamp (see the lower graph of FIG. 2), color rendering is improved and objects can be naturally viewed, thereby protecting a viewer's eyesight.

Meanwhile, it was found that the case in which red light in a wavelength range of 620 to 700 nm was added was more effective in the provision of a natural sensation than the case in which violet light in a wavelength range of 380 to 400 nm was added.

Accordingly, when green light in a wavelength range of 498 to 530 nm and red light in a wavelength range of 620 to 700 nm are added to light emitted from an existing fluorescent lamp, a viewer can have a sensation in which resulting light is similar to natural light. When violet light in a wavelength range of 380 to 400 nm is further employed, as shown in the lower graph of FIG. 2, the sensation in which light is more similar to natural light can be realized.

Furthermore, bluish green light having a wavelength of about 495 nm, at which rod cells have high sensitivity, is further added, so that most photoreceptor cells are highly activated, thereby improving sharpness.

Next, a fluorescent desk lamp capable of protecting eyesight will be described below as an embodiment of the eyesight protection lighting apparatus manufactured using the results of the research of the inventor.

In the desk lamp of the present invention, LEDs that emit green light in a wavelength range of 498 to 530 and red light in a wavelength range of 620 to 700 nm are added to an existing fluorescent lamp.

Now, a method of manufacturing the desk lamp capable of protecting eyesight according to the present invention will be described below with reference to FIGS. 3 to 6.

In order to produce green light in a wavelength range of 498 to 530 nm and red light in a wavelength range of 620 to 700 nm at low cost, a plurality of LEDs are used.

Figure 3:
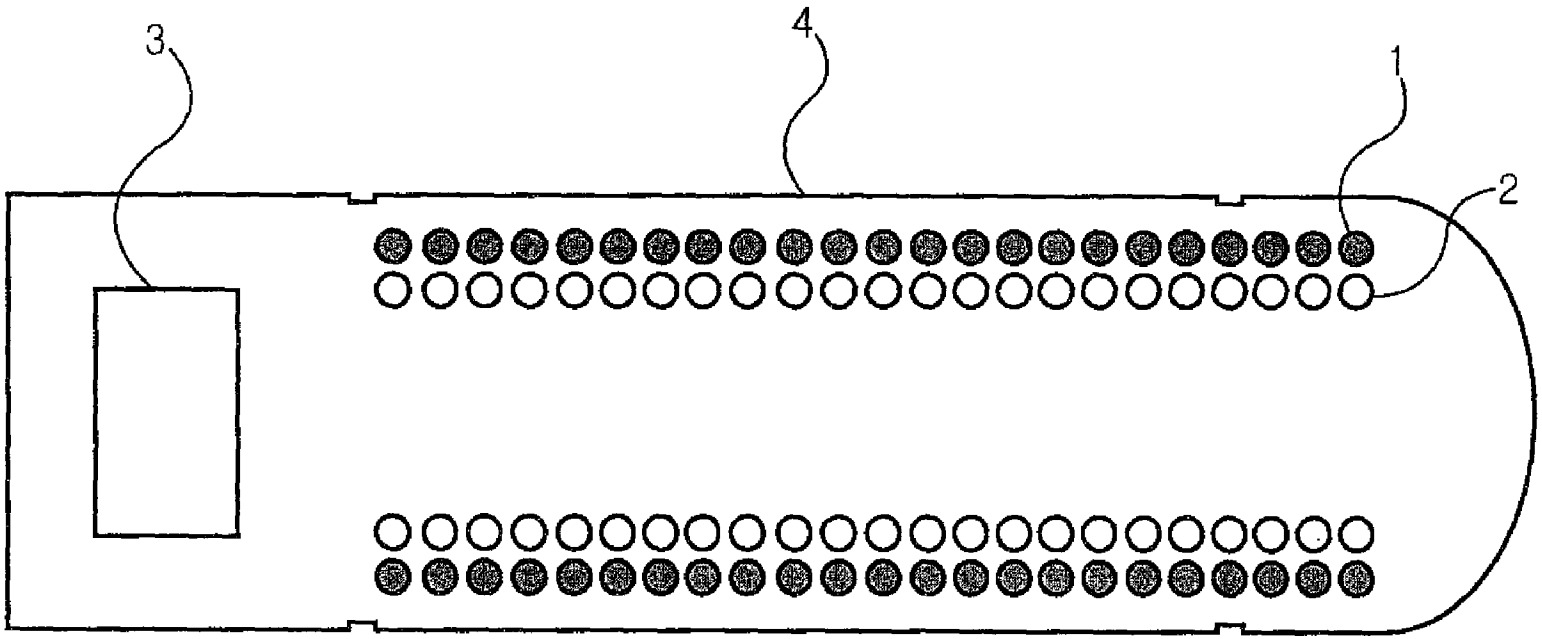
FIG. 3 is a diagram showing a board that is used for a desk lamp capable of protecting eyesight according to an embodiment of the present invention.

First, as shown in FIG. 3, two rows of LEDs 1 for green light in a wavelength range of 498 to 530 nm and two rows of LEDs 2 for red light in a wavelength range of 620 to 700 nm are alternately arranged on a board 4, and a socket for a fluorescent lamp is disposed between the LEDs 1 and 2. AC power wiring (not shown) for applying AC power from an inverter ballast 12 for a fluorescent lamp and DC power wiring (not shown) for applying DC power from a DC power supply 13 for LEDs 1 and 2 is disposed on the back of the board 4. Since the AC and DC power wiring is located on the back of the board 4 in FIG. 3, the AC and DC power wiring is not shown in FIGS. 3 to 5. In this case, the number of LEDs 1 and 2 is appropriately determined in consideration of the intensity of the light of the fluorescent lamp 7, inserted into the socket 3, and the intensity of the light of each of the LEDs 1 and 2.

Figure 4:
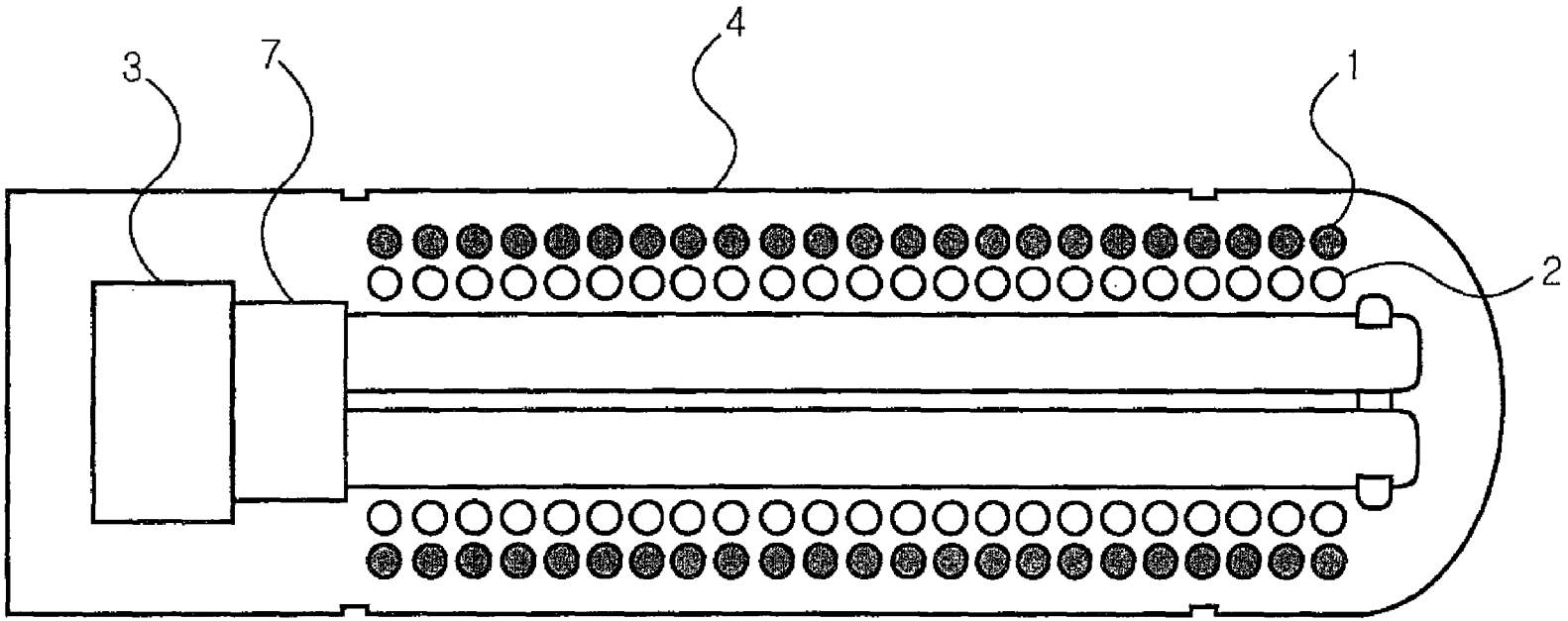
FIG. 4 is a diagram showing a board assembly that is constructed by fitting a fluorescent lamp into the board of FIG. 3.

Now, the board 4, including a fluorescent lamp, is constructed by inserting the fluorescent lamp 7 (although a U-shaped fluorescent lamp is shown in FIG. 4, a tube-shaped fluorescent lamp may be used) into the socket 3 on the board 4 of FIG. 3, as shown in FIG. 4.

Figure 5:
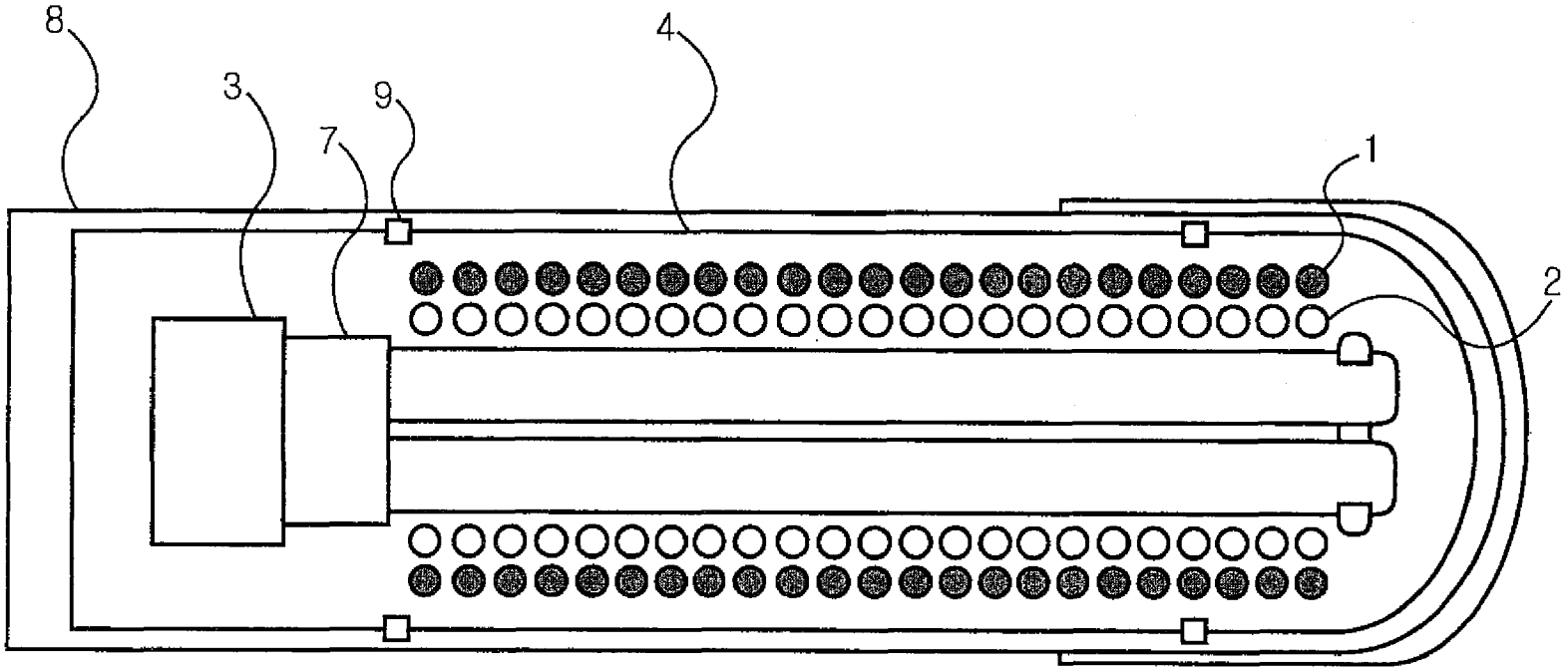
FIG. 5 is a diagram showing a structure in which the board assembly of FIG. 4 is fitted into a desk lamp shade.
Figure 6:
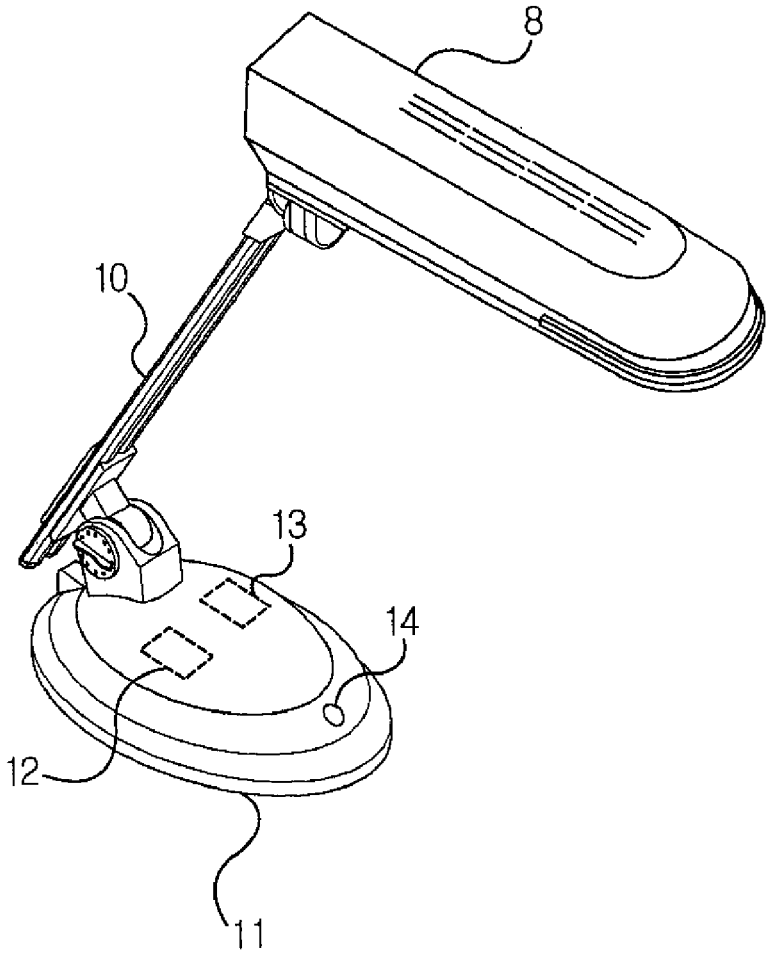
FIG. 6 is a perspective view showing a desk lamp capable of protecting eyesight according to the present invention.

Thereafter, a desk lamp shade assembly according to the present invention is constructed by fastening the board 4 to a desk lamp shade 8 using screws or by fitting the board 4 into elastic fastening members 9 attached to the desk lamp shade 8, as shown in FIG. 5, and the eyesight protection desk lamp according to the present invention is constructed by combining the desk lamp shade assembly with an arm 10 and a base 11, as shown in FIG. 6.

In this case, the inverter ballast 12 for a fluorescent lamp and the DC power supply 13 for LEDs are disposed inside the base 11, and wiring for the output of AC power from the inverter ballast 12 for a fluorescent lamp and wiring for the output of DC power from the DC power supply 13 for LEDs are respectively connected to the above-described pieces of wiring, disposed on the board 4, through the arm 10.

When home AC power is supplied to the inverter ballast 12 and the DC power supply 13, disposed in the base 11, by turning on a switch 14, the output of the inverter ballast 12 is supplied to the socket 3 for a fluorescent lamp, while the output of the DC power supply 13 is supplied to the LEDs 1 and 2 through the DC power wiring.

As described above, when a user turns on the switch 14, LEDs 1 and 2, together with the fluorescent lamp 7, are turned on, so that blue light in a wavelength range of 430 to 450 nm, red-orange light in a wavelength range of 600 to 620 nm and yellow-green light in a wavelength range of 530 to 560 nm are mainly emitted from the fluorescent lamp 7, and green light in a wavelength range from 498 to 530 nm and red light in a wavelength range of 620 to 700 nm are mainly emitted from the LEDs 1 and 2. As a result, blue light, red light and green light are emitted at similar intensities, thereby emitting light that has improved color rendering and is similar to natural light.

Meanwhile, as explained above, according to the research of the inventor of the present invention, when violet light in a wavelength range of 350 to 400 nm is further added, color rendering is further improved, and emitted light is more similar to natural light, and thus violet LEDs capable of emitting light in a wavelength range of 350 to 400 nm may be disposed on the board 4, in addition to the above-described LEDs 1 and 2.

Furthermore, it is possible to further add LEDs capable of emitting bluish green light having a wavelength of about 495 nm, to which rod cells are highly sensitive.

Moreover, when an anti-glare filter is additionally attached to the lamp shade 8 of FIG. 5, glare can be prevented.

Furthermore, although only the eyesight protection desk lamp using a fluorescent lamp has been described above, the principle of the present invention, in which light similar to natural light can be realized by combining a fluorescent lamp with LEDs, can be applied to various types of fluorescent lamp lighting apparatuses used in homes and offices.

For example, in the case of square fluorescent lamps, which are widely used in homes, a square fluorescent lamp capable of protecting eyesight is constructed by appropriately arranging fluorescent lamp sockets and LEDs capable of emitting green light in a wavelength range of 498 to 530 nm and red light in a range of 620 to 700 nm on a board, inserting fluorescent lamps into the sockets and fastening the board to a lamp shade in a manner similar to that for the above-described desk lamp.

Meanwhile, although one or more fluorescent lamp sockets, together with LEDs, have been described as being disposed on a board above, it is possible to dispose only LEDs on a board and to dispose one or more sockets for one or more fluorescent lamps at a separate location.

According to the above-described present invention, it is possible to provide an eyesight protection lighting apparatus that is constructed by combining one or more inexpensive fluorescent lamps with LEDs, thereby emitting light similar to natural light.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A lighting apparatus using one or more fluorescent lamps, the lighting apparatus comprising:

one or more sockets for accommodating the fluorescent lamps as main light sources of light to provide major brightness;

a board for supporting Light Emitting Diodes (LEDs) for emitting green light in a wavelength range of 498 to 530 nm, LEDs for emitting red light in a wavelength range of 620 to 700 nm, and LEDs for emitting bluish green light at about 495 nm, the LEDs improving color rendering and sharpness;

a fluorescent lamp driver for driving the fluorescent lamps; and a power supply for supplying power to the LEDs.

2. The lighting apparatus as set forth in claim 1, wherein the board is further provided with LEDs that emit violet light in a wavelength range of 350 to 400 nm.

3. The lighting apparatus as set forth in claim 1, wherein the sockets are mounted on the board.

4. The lighting apparatus as set forth in claim 1, wherein the lighting apparatus is a desk lamp.

5. The lighting apparatus as set forth in claim 1, wherein at least one of the fluorescent lamps is a U-shaped fluorescent lamp.

6. The lighting apparatus as set forth in claim 1, wherein at least one of the fluorescent lamps is a tube-shaped fluorescent lamp.

7. The lighting apparatus as set forth in claim 1, further comprising an anti-glare filter.

8. The lighting apparatus as set forth in claim 1, wherein the fluorescent lamp driver is an inverter ballast.

* * * * *